US006812907B1

(12) United States Patent
Gennetten et al.

(10) Patent No.: US 6,812,907 B1
(45) Date of Patent: Nov. 2, 2004

(54) SEGMENTED ELECTRONIC DISPLAY

(75) Inventors: K Douglas Gennetten, Ft Collins, CO (US); Charles H McConica, Corvallis, OR (US); David K. Campbell, Loveland, CO (US); Donald J Stavely, Windsor, CO (US); Paul M Hubel, Mt View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 806 days.

(21) Appl. No.: 09/619,525

(22) Filed: Jul. 19, 2000

(51) Int. Cl.[7] ..... G09G 5/00

(52) U.S. Cl. ..... 345/1.3; 345/102; 345/103; 345/33

(58) Field of Search ..... 345/1.1, 1.3, 33, 345/102–104, 173, 903

(56) References Cited

U.S. PATENT DOCUMENTS

| | | | | | |
|---|---|---|---|---|---|
| 5,528,266 | A | | 6/1996 | Arbeitman et al. | 345/173 |
| 5,796,382 | A | * | 8/1998 | Beeteson | 345/102 |
| 6,184,953 | B1 | * | 2/2001 | Greene et al. | 349/74 |
| 6,292,157 | B1 | * | 9/2001 | Greene et al. | 345/1.3 |
| 6,340,957 | B1 | * | 1/2002 | Adler et al. | 345/1.3 |
| 6,496,236 | B1 | * | 12/2002 | Cole et al. | 349/61 |
| 6,621,520 | B1 | * | 9/2003 | Sawanobori | 348/341 |

* cited by examiner

*Primary Examiner*—Bipin Shalwala
*Assistant Examiner*—Ricardo Osorio

(57) ABSTRACT

An electronic display comprises a plurality of independently operable segments. Each of the plurality of independently operable segments comprises a plurality of picture elements.

15 Claims, 4 Drawing Sheets

SEGMENTED ELECTRONIC DISPLAY

FIELD OF THE INVENTION

This invention relates to display panels especially for use in portable devices and more specifically to a segmented display in which the segments may be individually enabled or disabled to minimize power use.

BACKGROUND

Electronic devices often require display panels to display text or graphics. However, display panels are expensive and power hungry devices. As electronic devices become more popular, efforts have been made to reduce power requirements. For example, more efficient display hardware and power management software is used in most new electronic devices. However, even with power management software to turn off the device when not in use, the most efficient displays remain too power hungry for use in some applications. In particular, portable or battery powered electronic devices often include display panels which are smaller than ideal, simply to conserve power. As a result, the devices have incredibly complex user interfaces designed for very small displays which cannot contain a large menu or detailed instructions.

For example, liquid crystal displays (LCD) have seen widespread use as portable devices have become increasingly powerful and popular. LCD's are used to display information either in monochrome (black and white) or color. LCD's are currently the most cost effective type of display when a lightweight small display is needed. LCD's also use less electrical power than other typical display technologies. As a result, LCD's are found in most portable electronic device which need to display information, such as digital cameras, portable computers, and children's toys.

An LCD typically consists of two sheets of glass separated by a sealed-in liquid crystal material which is normally transparent. The outer surface of each glass sheet is coated with a transparent electrically conductive material such as tin oxide or indium oxide. The coating on the front, or viewing, surface is etched into characters or symbols that will be displayed on the LCD. On LCD's which need to display more complex information, the coating on the top surface is etched into an array of small shapes which may be flexibly combined during operation to form characters or symbols. Each of the etched portions have electrical conductors leading to the edge of the LCD. When an electrical voltage is applied between the front and back electrode coatings, the normally orderly arrangement of the liquid crystal molecules is disrupted. This disruption causes the liquid crystal material between the energized electrode coatings to darken, while the surrounding unenergized liquid crystal material remains transparent. The etched portions on the front coating are selectively energized so that the corresponding darkened regions on the LCD form easily viewable characters or symbols. A backlight is often used to illuminate the LCD from behind, increasing the contrast between the transparent and darkened regions on the LCD to improve readability.

However, LCD's are not without their disadvantages. Even though they are very power efficient compared to other typical display technologies, the power required to operate an LCD can quickly drain the batteries in a portable device. Therefore, most portable devices such as digital cameras employ smaller than ideal LCD's, making it difficult to read characters on the display. The user interface of a portable device is also complicated by a smaller than ideal LCD, since large menus providing access to the device functions cannot be displayed on a small LCD. Large menus are therefore typically divided into many levels of small menus which are confusing and tedious to use. Images displayed on a smaller than ideal LCD are also difficult to view, and are so compressed that details are lost. A common example is the extraordinarily complex user interfaces common to today's digital cameras.

Other display devices are available for electronic devices, such as plasma discharge panels (PDP's), which can produce a much better image than LCD's. However, these generally require even more power than LCD's.

Consequently, a need exists for a display with relatively low power requirements allowing larger displays in electronic devices. A further need exists for a display with variable power requirements that can be adjusted according to the varying power needs of the display as larger or smaller images are displayed.

SUMMARY

To assist in achieving the aforementioned needs, the inventors have devised a segmented display panel for use in electronic devices, particularly in portable electronic devices such as digital cameras. The preferred segmented display has a smaller rectangular segment surrounded by a larger U-shaped segment. The two segments may be powered and operated independently or jointly. When only small items need to be displayed, the larger segment is turned off while the smaller segment display is active. When larger items need to be displayed, such as photographs, the two segments are jointly powered and are used together to display the items.

The invention may comprise an electronic display having a plurality of independently operable segments. Each of the plurality of independently operable segments comprises a plurality of picture elements.

The invention may also comprise a digital camera. The digital camera includes an optical imaging assembly, a storage device electrically connected to the optical imaging assembly, and segmented display means electrically connected to the storage device.

The invention may also comprise an electronic apparatus having a segmented display. The segmented display comprises a plurality of independently operable display segments, wherein each of the plurality of independently operable display segments is located adjacent at least one other of the plurality of independently operable display segments.

BRIEF DESCRIPTION OF THE DRAWING

Illustrative and presently preferred embodiments of the invention are shown in the accompanying drawing, in which.

DESCRIPTION OF THE PREFERRED EMBODIMENT

Figure 1:
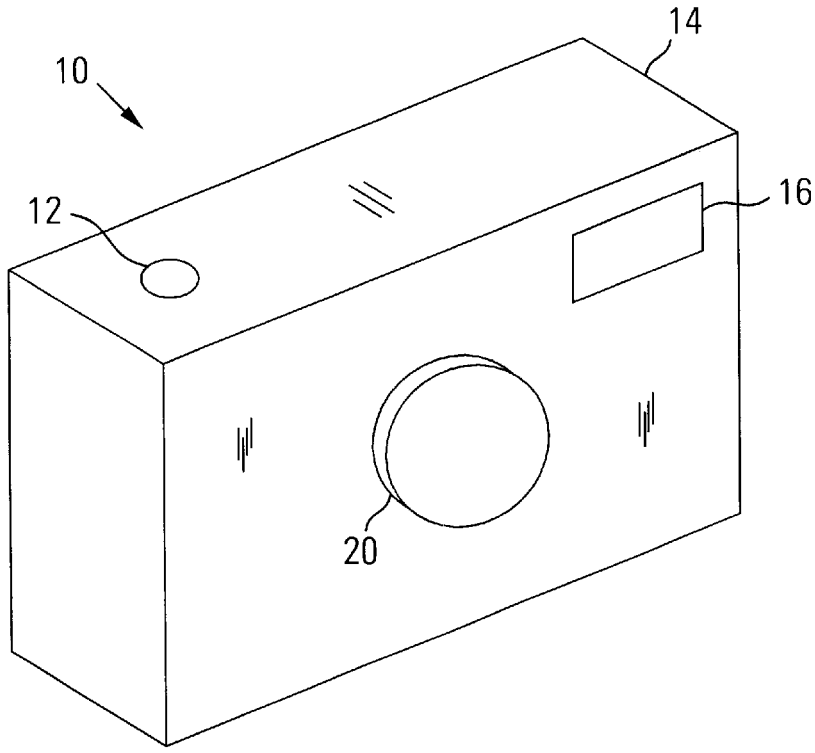
FIG. 1 is a front perspective view of a digital camera with a segmented display panel.

The drawing and description, in general, disclose an electronic display having a plurality of independently operable segments. Each of the plurality of independently operable segments comprises a plurality of picture elements.

The drawing and description also disclose a digital camera. The digital camera includes an optical imaging assembly, a storage device electrically connected to the optical imaging assembly, and segmented display means electrically connected to the storage device.

The drawing and description also disclose an electronic apparatus having a segmented display. The segmented display comprises a plurality of independently operable display segments, wherein each of the plurality of independently operable display segments is located adjacent at least one other of the plurality of independently operable display segments.

A segmented electronic display 22 may be used in electronic devices (e.g., 10) to provide a large display while conserving power in the device. Typical electronic devices benefitting from a segmented electronic display 22 include any electronic device that displays either large or small amounts of information during different operational states and for which power consumption is an issue. In particular, portable electronic devices such as a digital camera 10 benefit greatly by the use of a segmented electronic display 22.

Figure 2:
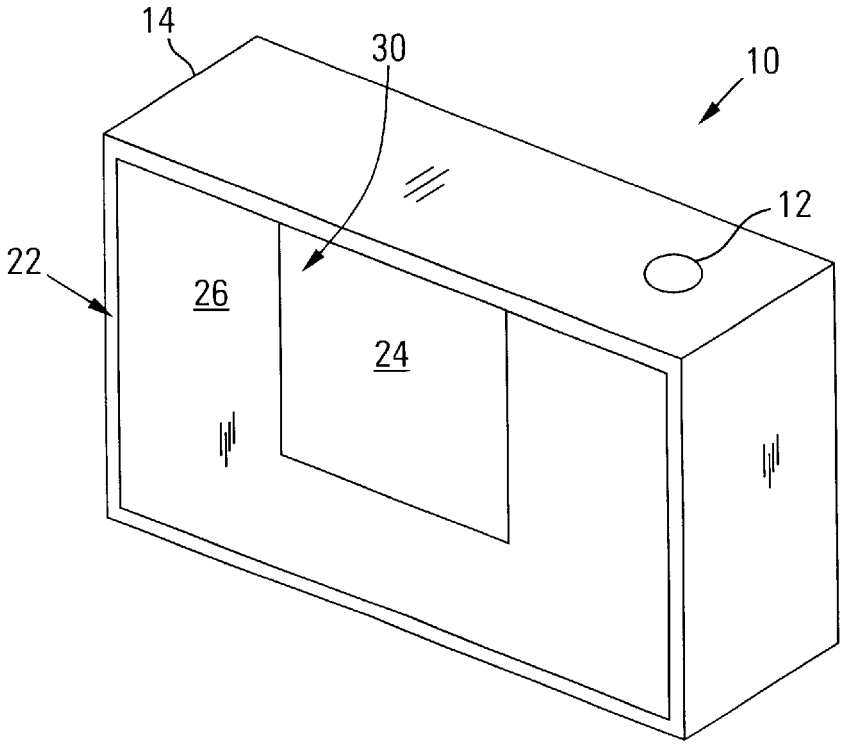
FIG. 2 is a rear perspective view of the digital camera of FIG. 1 showing the segmented display panel.

A digital camera 10 (FIGS. 1 and 2) having a segmented electronic display 22 may be used to detect and store the image of a subject or scene in electrical form. As digital cameras 10 have become more portable and computers have become more widely used, digital photography and document imaging has developed into a very useful tool. Digital photographs may be quickly reviewed and transmitted electronically to others without waiting for film development.

Digital cameras 10 are well-known in the art and are analogous to ordinary film-type cameras, except that the film is replaced with a photoelectric detector (e.g., a charge-coupled device (CCD)). The photoelectric detector converts the light received by the camera into electronic signals, which may be digitized and stored as digital image data. For example, the resulting digital image data may be stored in an electronic memory system, such as a random access memory (RAM), or may be stored on a magnetic or optical disk of the type commonly used to store digital data.

The segmented electronic display 22 in the digital camera 10 is used to display information for the photographer such as camera settings, the number of digital images stored in memory, or to display captured images, allowing the images to be previewed and deleted or retaken without printing them or transferring them to a computer.

The segmented electronic display 22 in a preferred embodiment has two segments, segment A 24 and segment B 26, which are located adjacent one another to form one large display 22. In the preferred embodiment, segment A 24 is a smaller rectangular display and segment B 26 is a larger, notched rectangle having a U-shape. Segment A 24 fits into the notch 30 in segment B 26 so that the segmented electronic display 22 forms a rectangle.

The two segments A 24 and B 26 may be operated independently or concurrently as needed. Simple information may be displayed on segment A 24 while segment B 26 remains shut down so that it draws little or no power. Complex information may be displayed on the segmented electronic display 22 by operating both segments A 24 and B 26. For example, camera settings or menus may be displayed on segment A 24 while segment B 26 is left shut down, thus conserving power. A full image may be displayed on the entire segmented electronic display 22 by displaying a portion of the image on segment A 24 and the rest of the image on segment B 26. Complicated portions of menus may also be displayed on the entire segmented electronic display 22, thereby simplifying complex interaction tasks.

The digital camera 10 is designed or programmed to minimize power usage by shutting down segment B 26 whenever possible, using only segment A 24 to display simple information. The digital camera 10 thus powers the entire segmented electronic display 22, including segment B 26, only when complex information must be displayed.

The segmented electronic display 22 in an electronic device thus provides a large, easy to read display panel, while enabling the electronic device to conserve power when only simple information is displayed. The user interface of the electronic device can therefore be greatly improved, since large menus can be displayed on the entire segmented electronic display 22 without breaking them into deep and complicated layers of submenus. Large images may also be displayed on the entire segmented electronic display 22 when needed.

Before describing the segmented electronic display 22, an exemplary digital camera 10 which may employ a segmented electronic display 22 will be described. A digital camera 10 (FIGS. 1 and 2) comprises a housing portion 14 which is sized to receive the various systems and components required by the digital camera 10. For example, in the embodiment shown and described herein, the housing 14 is sized to receive an optical imaging assembly, a storage device to store the image data collected by the optical imaging assembly, and a control system for providing a user interface and for processing and formatting the image data. A lens 20 in the optical imaging assembly is located in the housing 14 to allow light to enter the digital camera 10. The housing 14 may also be sized to receive a power source such as one or more batteries. At least one control button 12, such as a shutter release button, is provided on the outside of the housing 14. The digital camera 10 preferably includes an illumination system such as a flash 16 mounted on the outside of the housing 14. The segmented electronic display 22 is also located on the outside of the housing 14. Each of the foregoing systems and devices will now be described in detail.

The housing 14 of the digital camera 10 may comprise a generally rectangularly shaped structure sized to receive the various internal components of the camera 10. The housing 14 is sized to receive the optical imaging assembly, which includes a lens 20 and an electrical photodetector. The lens 20 is preferably telecentric or near telecentric. The photodetector detects image light focused thereon by the lens 20 and comprises a CCD, although other devices may be used. A typical CCD comprises an array of individual cells or "pixels," each of which collects or builds-up an electrical charge in response to exposure to light. Since the quantity of the accumulated electrical charge in any given cell or pixel is related to the intensity and duration of the light exposure, a CCD may be used to detect light and dark spots on an image focused thereon.

The term "image light" as used herein refers to the light that is focused onto the surface of the detector array by the lens 20. The image light may be converted into digital signals in essentially three steps. First, each pixel in the CCD detector converts the light it receives into an electric charge. Second, the charges from the pixels are converted into analog voltages by an analog amplifier. Finally, the analog voltages are digitized by an analog-to-digital (A/D) converter. The digital data then may be processed and/or stored as desired.

A storage device is located in the housing 14 to store the image data collected by the optical imaging assembly. The storage device preferably comprises a random access memory (RAM), or may comprise a magnetic, optical, or other solid state storage medium. A control system is located in the housing 14 to process and format the image data, either before or after storage in the storage device. The control system preferably comprises a microprocessor and associated memory. Alternatively, the control system may comprise a hard-coded device such as an application specific integrated circuit (ASIC). The control system processes image data for display on the segmented electronic display 22, among other tasks. For example, the control system also displays camera settings and menus on the segmented electronic display 22, and processes user commands.

The segmented electronic display 22, as will be described in more detail hereinafter, preferably comprises a liquid crystal display (LCD). The segmented electronic display 22 may also comprise any other suitable display device that is segmented to reserve power. The segmented electronic display 22 is preferably flat, but may alternatively have a non-flat contoured surface if desired.

Digital cameras and camera bodies are well-known in the art and could be easily provided by persons having ordinary skill in the art after having become familiar with the teachings of the present invention. Therefore, the housing 14 utilized in one preferred embodiment of the present invention, as well as the various ancillary systems and devices (e.g., battery systems and storage devices) that may be utilized in one preferred embodiment of the present invention will not be described in further detail herein.

During operation of the digital camera 10, the camera 10 is oriented with the lens 20 directed at a subject. The subject may be monitored either through a viewfinder (not shown), or on the segmented electronic display 22. When the digital camera 10 is properly oriented, the shutter release button 12 is pressed. The photodetector then converts the image light directed thereon by the lens 20 into electrical image data, which are stored in the storage device. The control system then processes the image data and displays the captured image on the segmented electronic display 22.

Figure 3:
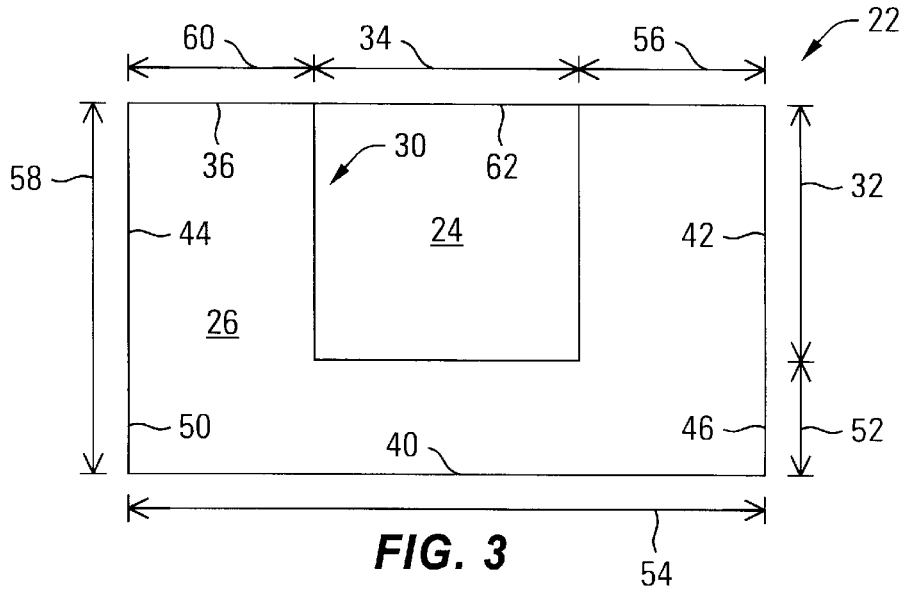
FIG. 3 is a diagram of a segmented display panel having a first segment positioned along the top edge of a second segment.

Referring now to FIG. 3, a preferred segmented electronic display 22 comprises two interlocking or contiguous segments, segment A 24 and segment B 26. Segment A 24 may be operated without segment B 26, but segment B 26 is preferably always used in conjunction with segment A 24 to form a single large display panel. Segment A 24 has a height 32 of about 40 mm and a width 34 of about 40 mm. Segment B 26 has a notch 30 formed in a top edge 36, giving it a U shape. The notch 30 is preferably centered along the top edge 36 of segment B 26. Segment B 26 therefore has a base 40 with two arms 42 and 44 extending perpendicularly from the ends 46 and 50 of the base 40. The base 40 has a height 52 of about 20 mm and a width 54 of about 80 mm. Each arm 42 and 44 has a height 32 of about 40 mm and a width 56 and 60 of about 20 mm. Segment B 26 therefore has a height 58 of about 60 mm. The notch 30 in segment B 26 has substantially the same size and shape as segment A 24 so that segment A 24 fills the notch 30, with the top 62 aligned with the top 36 of segment B 26. The two segments A 24 and B 26 thus combine to form a rectangular display 22.

Segment A 24 has a shape and size that is optimized to display the user interface on the digital camera 10, and is preferably square. Segment B 26 in conjunction with segment A 24, in contrast, has a shape and size that is optimized to display images on the digital camera 10, thus preferably has an aspect ratio to match that of the captured images. Note that the dimensions given herein are exemplary, based on the described digital camera 10, but will be modified as needed according to the particular electronic device.

The digital camera 10 is programmed to use the smaller segment 24 whenever possible, minimizing power usage in the camera 10, and to use both segments 24 and 26 when more information must be displayed than will fit on the smaller segment 24 alone. The digital camera 10 may also be programmed to shut down the larger segment 26 during extended periods of non-use, leaving it powered for only a predetermined amount of time after the user presses a control on the camera.

Figure 4:
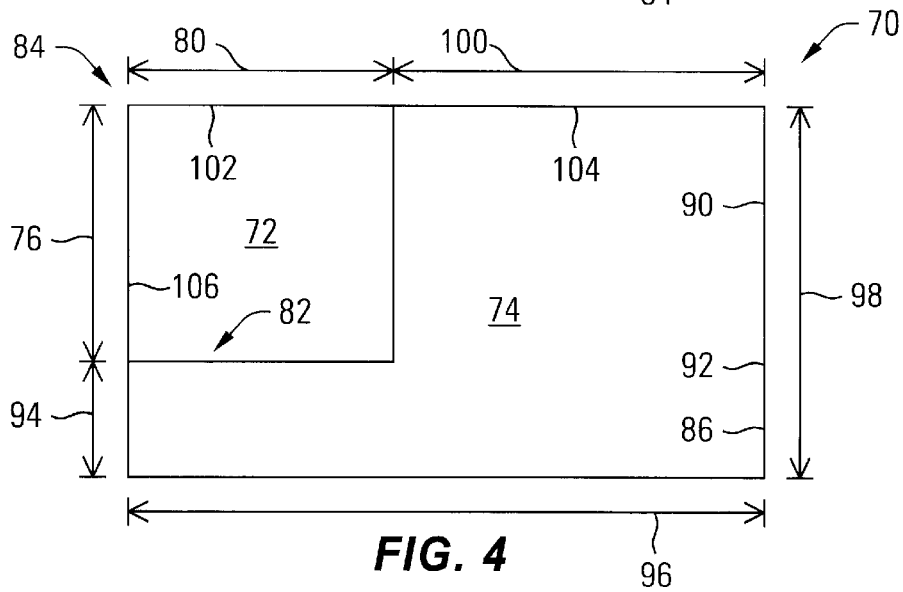
FIG. 4 is a diagram of a segmented display panel having a first segment positioned in the upper left corner of a second segment.

In a second exemplary configuration, as illustrated in FIG. 4, a segmented electronic display 70 may comprise two contiguous segments, segment A 72 and segment B 74, with segment A 72 located in a corner of the display 70. Segment A 72 has a height 76 of about 40 mm and a width 80 of about 40 mm. Segment B 74 has a notch 82 formed in the upper left corner 84. Segment B 74 therefore has a base 86 with an arm 90 extending perpendicularly from the end 92 of the base 86. The base 86 has a height 94 of about 20 mm and a width 96 of about 80 mm. The arm 90 has a height 76 of about 40 mm and a width 100 of about 40 mm. Segment B 74 therefore has a height 98 of about 60 mm. The notch 82 in segment B 74 has substantially the same size and shape as segment A 72 so that segment A 72 fills the notch 82, with the top 102 of segment A 72 aligned with the top 104 of segment B 74, and the left side 106 of segment A 72 aligned with the left side 110 of segment B 74. The two segments A 72 and B 74 thus combine to form a rectangular display 70.

Figure 5:
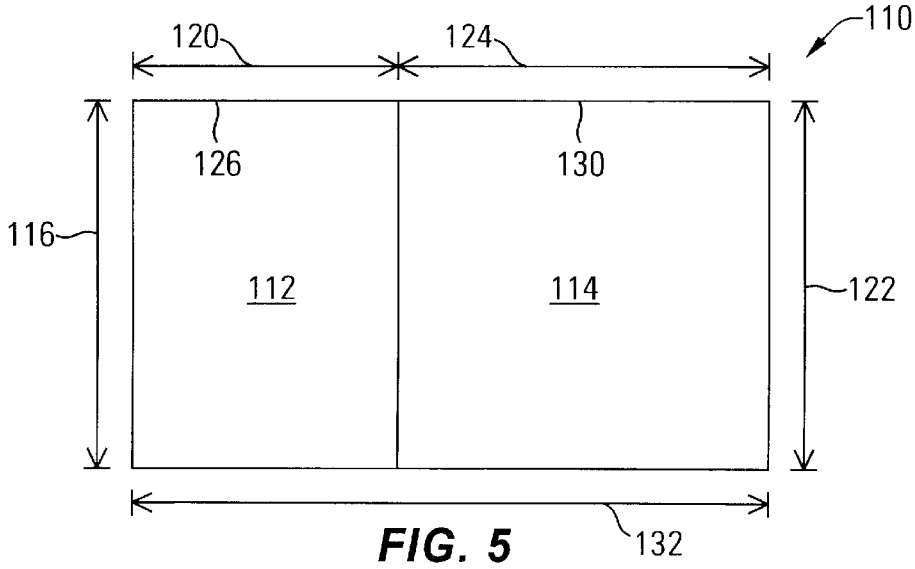
FIG. 5 is a diagram of a segmented display panel having a first segment positioned along the left edge of a second segment.

In a third exemplary configuration, as illustrated in FIG. 5, a segmented electronic display 110 may comprise two contiguous segments, segment A 112 and segment B 114, with segment A 112 located along a side of the display 110. Segment A 112 has a height 116 of about 60 mm and a width 120 of about 40 mm. Segment B 114 has a height 122 of about 60 mm and a width 124 of about 40 mm. Segment A 112 and segment B 114 thus have the same height 116 and 122, and the top 126 of segment A 112 is aligned with the top 130 of segment B 114. The two segments A 112 and B 114 thus combine to form a rectangular display 110 having a width 132 of about 80 mm and a height 116 and 122 of about 60 mm.

As mentioned above, the configuration of the panels will depend upon the electronic device and may be modified from the exemplary embodiments above. Further, the number of independently operable panels may be varied according to the application.

Figure 6:
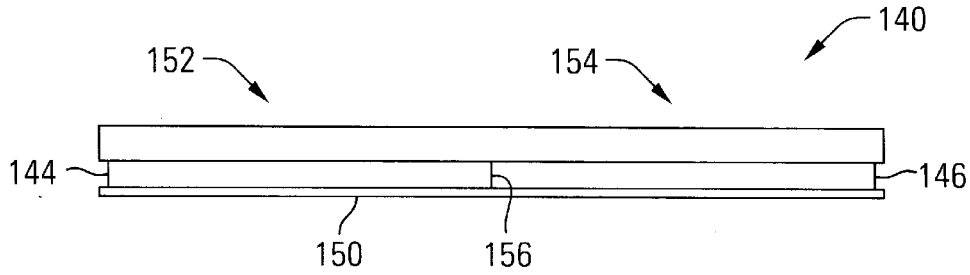
FIG. 6 is a side view of a segmented display panel having LED array backlights.

In the preferred embodiment, the segmented electronic display consists of an LCD panel in which the liquid crystal portion is one solid unsegmented unit and the backlight under the liquid crystal portion is segmented to provide the variable power requirements in the display. For example, as illustrated in FIG. 6, a segmented electronic display 140 is made of a backlit LCD panel having a single unsegmented liquid crystal panel 142 and two light emitting diode (LED) arrays 144 and 146 mounted adjacent one another on a mounting surface 150. The two LED arrays 144 and 146 provide a backlight for the LCD panel 142 to improve contrast and readability, as discussed previously. The two LED arrays 144 and 146 are independently operable so that the first LED array 144 backlights a first segment 152 and the second LED array 146 backlights a second segment 154. Each of the two LED arrays 144 and 146 may be powered independently so that only one segment (e.g., 152) is illuminated or that both LED arrays 144 and 146 are powered together to form one large display panel.

The LCD panel 142 is preferably unsegmented, but different portions of the panel 142 are typically independently accessible. Therefore, picture elements in the first segment 152 may be accessed and turned on or off while only the first LED array 144 is powered, and picture elements in the first segment 154 are not accessed and are therefore left turned off while the second LED array 146 is unpowered.

Alternatively, if the LCD panel 142 uses power even when picture elements in the segments 152 and 154 are not turned on, the segments 152 and 154 may be electrically separated so that each can be independently powered like the LED backlights 144 and 146. However, segmenting the liquid crystal in the LCD panel 142 may create a small visible discontinuity along the border between the segments.

The two LED arrays 144 and 146 are placed as closely together as possible so that a boundary 156 between them is as small as possible. To provide even illumination of the LCD panel 142, light should be able to cross the boundary 156 between the two LED arrays 144 and 146. Thus, when both segments 152 and 154 are being used together, and the two LED arrays 144 and 146 are powered simultaneously, light will blend across the boundary 156 between the two LED arrays 144 and 146, effectively forming one uniform backlight. If the LCD segments 152 and 154 are opaque when unpowered, there will not be a glow in the unused segment (e.g., 154) along the boundary 156 from the powered LED array 144. However, if the LCD segments 152 and 154 are transparent when unpowered, a glow may appear in the unused segment (e.g., 154) along the boundary 156 from the powered LED array 144. In an alternative embodiment, the boundary 156 between the two LED arrays 144 and 146 may be opaque to separate the illumination from the two LED arrays 144 and 146.

As discussed above, the picture elements in the segmented electronic display 140 may have any shape and size suitable for displaying information. For example, the picture elements may be an array of identical small generic shapes which are combined to form symbols, or may be entire symbols or parts of unique symbols.

Figure 7:
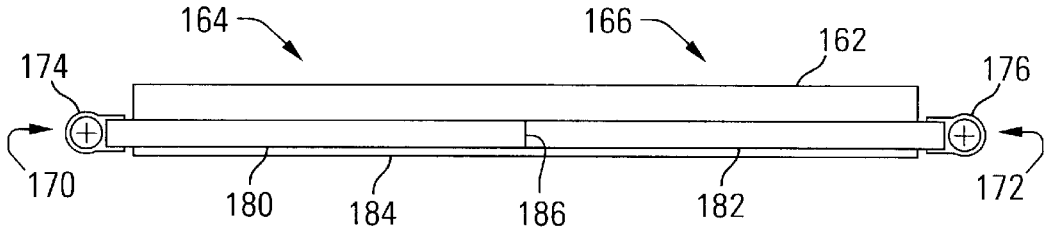
FIG. 7 is a side view of a segmented display panel having side mounted cold cathode fluorescent lamp backlights.

Referring now to FIG. 7, another segmented electronic display 160 includes an LCD panel 162 having two segments 164 and 166. As above, the two segments 164 and 166 are preferably formed by independently powerable backlights 170 and 172. In this embodiment, the backlights 170 and 172 consist primarily of a pair of cold cathode fluorescent lamps (CFLs) 174 and 176 and a corresponding pair of diffusers 180 and 182. The CFLs 174 and 176 are side mounted on the segmented electronic display and transmit light into the diffusers 180 and 182 which are mounted to a mounting surface 184 behind the LCD panel 162. As light enters the sides of the diffusers 180 and 182 from the CFLs 174 and 176, it is diffused up through the LCD panel 162 to backlight the panel 162. However, side mounted backlights 170 and 172 are not as uniform as the back mounted LED arrays 144 and 146 discussed above. Light is brightest at the edges of the segmented electronic display 160 and falls off uniformly near the middle of the display 160. In this embodiment, it may be desirable to provide an opaque boundary 186 between the diffusers 180 and 182 to prevent one CFL 174 from producing a gradient illumination across the entire segmented electronic display 160 even when the remote LCD segment 166 is unused.

Figure 8:
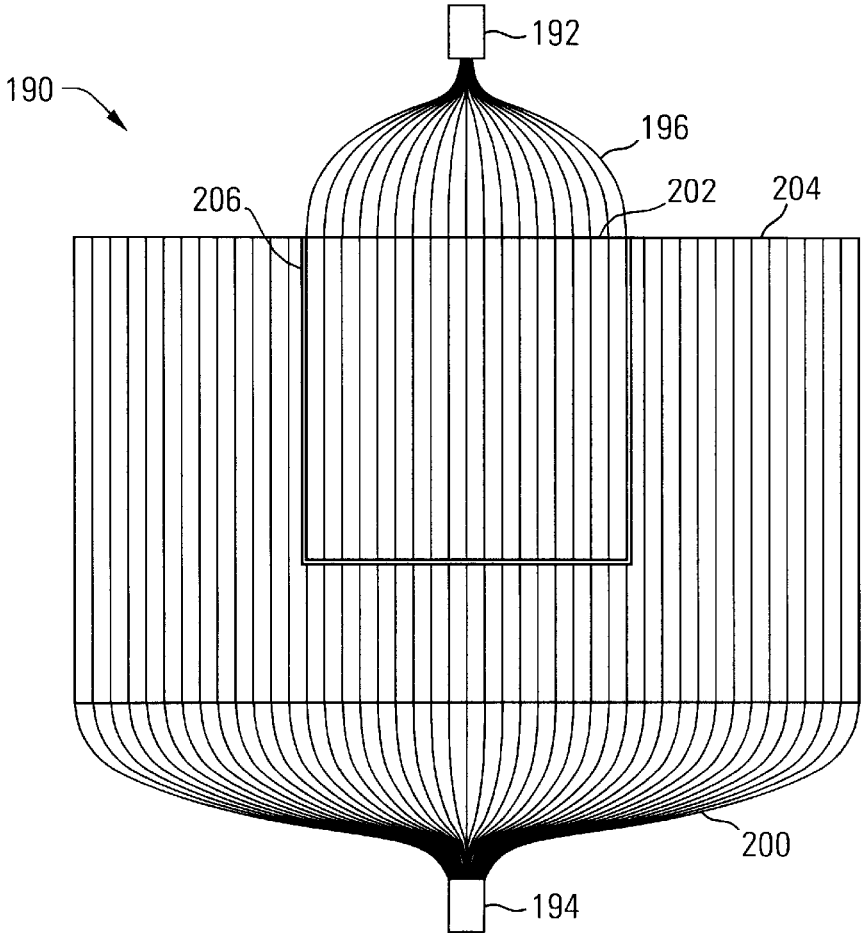
FIG. 8 is a top view of two backlights for a segmented display panel having side-mounted light sources with fiber optic panels.

Referring now to FIG. 8, another backlight 190 for a segmented electronic display is formed from side mounted light sources 192 and 194 which transmit light into arrays of optical fibers 196 and 200, respectively. The optical fibers 196 and 200 form fiber optic panels 202 and 204 which lie behind an LCD panel. As light travels through the fiber optic panels 202 and 204, part of the light crosses the walls of the fiber optic panels 202 and 204 to backlight the LCD panel. The light sources 192 and 194 are independently powerable to form two segments on the LCD panel, as discussed previously. The boundary 206 between the fiber optic panels 202 and 204 is preferably transparent or translucent to increase uniformity of illumination, as discussed above.

Many other types of lighting systems for LCD panels may be used to illuminate the segments in a segmented electronic display. Therefore, the exemplary embodiments discussed above should be seen as non-limiting.

Figure 9:
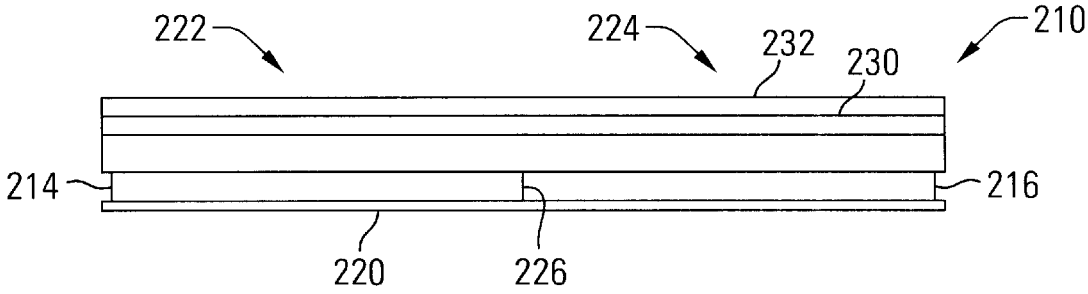
FIG. 9 is a side view of a segmented display panel having a touch screen and passive artwork.

Referring now to FIG. 9, another embodiment of a segmented electronic display 210 includes an LCD panel 212 backlit by two LED arrays 214 and 216, mounted on a mounting surface 220. The two LED arrays 214 and 216 are independently powerable to form two segments 222 and 224 on the LCD panel 212. The boundary 226 between the two LED arrays 214 and 216 is preferably translucent or transparent, as discussed above.

A passive artwork layer 230 is placed over the LCD panel 212 containing artwork or symbols for use with a user interface. The artwork in the passive artwork layer 230 is only visible when the backlight behind the artwork is off. When the passive artwork layer 230 is backlit, the symbols are substantially transparent. For example, symbols may be located in the passive artwork layer 230 to cover only one segment 222. When the associated LED array 214 is off, the symbols in the one segment 222 are reflective and are thus visible. When the LED array 214 is on, the symbols in the passive artwork layer 230 are backlit and become substantially transparent, thus are washed out to the point of becoming nearly invisible. This allows the unpowered segment to remain useful for the user interface even when the LCD panel is not powered.

A touch screen 232 is placed over the LCD panel 212 and the passive artwork layer 230, allowing the user to operate a user interface by pressing points on the touch screen 232. Touch screens are well known in the art and various components thereof are described in U.S. Pat. No. 5,528,266 which is hereby incorporated by reference for all that it discloses. The touch screen 232 may also be used in conjunction with the passive artwork layer 230 to improve the user interface. For example, symbols such as menus or icons may be formed in the passive artwork layer 230. When the symbols are not backlit, the symbols will be visible, and the user may press the touch screen 232 over the symbols to select functions in the electronic device. When the passive artwork layer 230 is backlit, the symbols become substantially transparent so that they do not interfere with image displays covering all segments of the segmented electronic display 210.

In another embodiment of a segmented electronic display, the display consists of a plasma display panel (PDP) having at least two independently operable segments. A PDP (not shown) consists of an array of individually addressable cells which can be turned on or off to produce light, usually of varying colors. In a preferred PDP segmented electronic display, a user interface activates only one segment of the display, preserving power by leaving at least one segment unused, such as in the configurations shown in FIGS. 3–5.

Alternatively, the PDP may consist of two separate, electrically distinct panels which are independently powered. During use, PDP's are partially electrically charged so that a small increase in electricity causes addressed cells to turn on. This embodiment uses even less power than the previous embodiment because only the active segment of the PDP segmented electronic display is partially electrically charged. However, the segments of the PDP segmented electronic display must be placed very closely together with a very narrow boundary to avoid forming a dark line in the display. Other types of display technologies may also be segmented as discussed herein to preserve power in electronic devices.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. An electronic display, comprising:

a plurality of independently operable segments located in said electronic display, wherein said plurality of independently operable segments comprises a first segment and a second segment, each of said plurality of independently operable segments comprising a plurality of picture elements, wherein said second segment has a rectangular shape, and wherein said first segment has a rectangular shape with a notch, and wherein said second segment is disposed in said notch in said first segment so that said first segment and said second segment together have a rectangular shape.

2. The electronic display of claim 1, wherein each of said plurality of independently operable segments comprises at least one boundary edge, and wherein at least one of said at least one boundary edges on each of said plurality of independently operable segments is at least partially contiguous with at least one of said at least one boundary edges on another of said plurality of independently operable segments.

3. The electronic display of claim 1, wherein said first segment is larger than said second segment.

4. The electronic display of claim 1, wherein said notch in said first segment is located along an edge of said first segment so that said first segment is U-shaped.

5. The electronic display of claim 1, wherein said plurality of independently operable segments comprise liquid crystal display elements.

6. The electronic display of claim 5, further comprising a plurality of independently operable backlights, wherein each of said independently operable backlights is located behind a different one of said plurality of independently operable segments.

7. The electronic display of claim 6, wherein said plurality of independently operable backlights comprise at least one light emitting diode.

8. The electronic display of claim 6, wherein said plurality of independently operable backlights comprise at least one fluorescent lamp.

9. The electronic display of claim 1, wherein said plurality of independently operable segments comprise plasma discharge display elements.

10. The electronic display of claim 1, wherein said plurality of picture elements comprise switchable dots, each of said switchable dots comprising a first state in which said switchable dot is visible and a second state in which said switchable dot is not visible.

11. The electronic display of claim 1, wherein said plurality of picture elements comprise switchable symbols, each of said switchable symbols comprising a first state in which said switchable symbol is visible and a second state in which said switchable symbol is not visible.

12. The electronic display of claim 1, further comprising a touch sensitive screen located over at least one of said plurality of independently operable segments.

13. An electronic display, comprising:

a plurality of independently operable segments located in said electronic display, each of said plurality of independently operable segments comprising a plurality of picture elements; and passive artwork located over at least one of said plurality of independently operable segments, wherein said passive artwork is substantially visible when said least one of said plurality of independently operable segments under said passive artwork is off, and wherein said passive artwork is substantially transparent when said least one of said plurality of independently operable segments under said passive artwork is on.

14. The electronic display of claim 13, wherein said passive artwork comprises a film that is substantially reflective when not backlit and substantially transparent when backlit.

15. The electronic display of claim 13, further comprising a plurality of independently operable backlights, wherein each of said independently operable backlights is located behind a different one of said plurality of independently operable segments, and wherein said passive artwork is substantially visible when said plurality of independently operable backlights behind said passive artwork is off, and wherein said passive artwork is substantially transparent when said plurality of independently operable backlights behind said passive artwork is on.

* * * * *